US007179094B2

(12) United States Patent
Kawahara et al.

(10) Patent No.: US 7,179,094 B2
(45) Date of Patent: Feb. 20, 2007

(54) SMT CONNECTOR

(75) Inventors: Yuzo Kawahara, Kanagawa (JP); Hidehisa Yamagami, Kanagawa (JP); Takahiro Ishiyama, Aichi (JP); Masahiro Takamatsu, Aichi (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/261,381

(22) Filed: Oct. 27, 2005

(65) Prior Publication Data

US 2006/0094298 A1 May 4, 2006

(30) Foreign Application Priority Data

Oct. 29, 2004 (JP) ..... 2004-316347

(51) Int. Cl.
*H01R 12/00* (2006.01)

(52) U.S. Cl. ..... 439/74

(58) Field of Classification Search ..... 439/637, 439/74, 346, 83, 570
See application file for complete search history.

(56) References Cited

U.S. PATENT DOCUMENTS 5,449,297 A 9/1995 Bellomo et al.
5,533,908 A 7/1996 Henry et al.
5,639,248 A * 6/1997 Yagi ..... 439/74
5,735,696 A * 4/1998 Niitsu et al. ..... 439/65
5,876,217 A * 3/1999 Ito et al. ..... 439/74
5,931,689 A * 8/1999 Patel ..... 439/346
5,971,809 A 10/1999 Ho
6,129,589 A 10/2000 Simmel et al.
6,254,429 B1 * 7/2001 Morita ..... 439/570
6,338,630 B1 * 1/2002 Dong ..... 439/74
6,338,633 B1 * 1/2002 Dong ..... 439/83
6,923,659 B2 * 8/2005 Zhang et al. ..... 439/74
2003/0100211 A1 5/2003 Wu

FOREIGN PATENT DOCUMENTS

JP 08-045579 2/1996
JP 2000-294324 10/2000

OTHER PUBLICATIONS

Partial European Search Report dated Feb. 9, 2006 for application No. EP 05 10 9874 for Tyco Electronics AMP K.K.

* cited by examiner

*Primary Examiner*—Chandrika Prasad
*Assistant Examiner*—Harshad C. Patel
(74) *Attorney, Agent, or Firm*—Barley Snyder LLC

(57) ABSTRACT

A surface mount technology connector comprises a housing provided with a plurality of contacts. At least one metal fitting is fixed to a sidewall of the housing. The metal fitting has a base and a soldering section for soldering to a circuit board. The base has a smaller width than the soldering section. The soldering section extends from a substantial center of the base with respect to the width thereof. The soldering section and a portion of the base extend approximately perpendicular to and away from a bottom of the sidewall of the housing. The sidewall of the housing has a solder viewing section at each side of the base. The solder viewing section retracts inward as the solder viewing section approaches the soldering section to expose the soldering section at the bottom of the sidewall of the housing.

20 Claims, 9 Drawing Sheets

SMT CONNECTOR

FIELD OF THE INVENTION

The invention relates to a connector mounted on a surface of a circuit board using surface mount technology (SMT) that has a housing with a metal fitting having a soldering section for securing the connector to the circuit board.

BACKGROUND OF THE INVENTION

In recent years, connectors mounted using SMT have gained popularity for interconnecting circuit boards because they easily make electrical connections to elements on the circuit board, they have high packaging contact densities, and other advantages. The connector is electrically connected to the circuit board by soldering a lead end of each of the contacts provided inside a housing of the connector to a pad on a surface of the circuit board. When the circuit board mounted with the connector is used, for example, in an automobile, however, the circuit board is subjected to vibrations, which can cause the connector to become disconnected from the circuit board. In order to securely connect the connector to the circuit board, Japanese Patent Laid-Open Nos. 2000-294324 and H8-45579 teach attaching metal fittings having soldering sections to the connector. The soldering sections of the metal fittings are soldered to the pads on the surface of the circuit board to securely connect the connector to the circuit board.

Due to the demand for smaller connectors, it is necessary to minimize the total length of the connector including the soldering section which protrudes from a sidewall of the housing of the connector. However, if the soldering sections of the metal fittings are arranged as close as possible to the housing, in order to minimize the total length of the connector, it becomes difficult to visually inspect whether the soldering sections are soldered to the pad on the circuit board due to the presence of the housing. In addition, due to sudden changes in ambient temperature, for example, in an automobile, the circuit board and the housing of the connector are subject to thermal expansion and contraction. As the circuit board and the housing are respectively formed of different materials, there is a difference in the amount of thermal expansion and contraction between them. In a case where the connector is securely fixed to the circuit board by soldering the metal fittings thereof to the circuit board, the difference in thermal expansion and contraction causes stress on the soldering section of the metal fittings and may eventually disconnect the soldering section from the circuit board. If the soldering section of the connector is removed from the circuit board, it is more likely to be electrically disconnected from the circuit board.

BRIEF SUMMARY OF THE INVENTION

It is therefore an object of the invention to provide a connector mounted on a surface of a circuit board using SMT that has a housing with a metal fitting having a soldering section for securing the connector to the circuit board wherein visual inspection of the solder is possible, the mounting area of the connector is minimized, and stress applied to the soldering section of the metal fitting is alleviated.

This and other objects are achieved by a surface mount technology connector comprising a housing provided with a plurality of contacts. At least one metal fitting is fixed to a sidewall of the housing. The metal fitting has a base and a soldering section for soldering to a circuit board. The base has a smaller width than the soldering section. The soldering section extends from a substantial center of the base with respect to the width thereof. The soldering section and a portion of the base extend approximately perpendicular to and away from a bottom of the sidewall of the housing. The sidewall of the housing has a solder viewing section at each side of the base. The solder viewing section retracts inward as the solder viewing section approaches the soldering section to expose the soldering section at the bottom of the sidewall of the housing.

This and other objects are further achieved by s surface mount technology connector, comprising a housing provided with a plurality of contacts. At least one metal fitting is fixed to a sidewall of the housing. The metal fitting has a base extending substantially parallel to the sidewall and a soldering section for soldering to a circuit board. The soldering section extends from a substantial center of the base with respect to a width thereof approximately perpendicular to and away from a bottom of the sidewall of the housing such that a gap is formed between the base and the bottom of the sidewall of the housing.

DETAILED DESCRIPTION OF THE INVENTION

Figure 1:
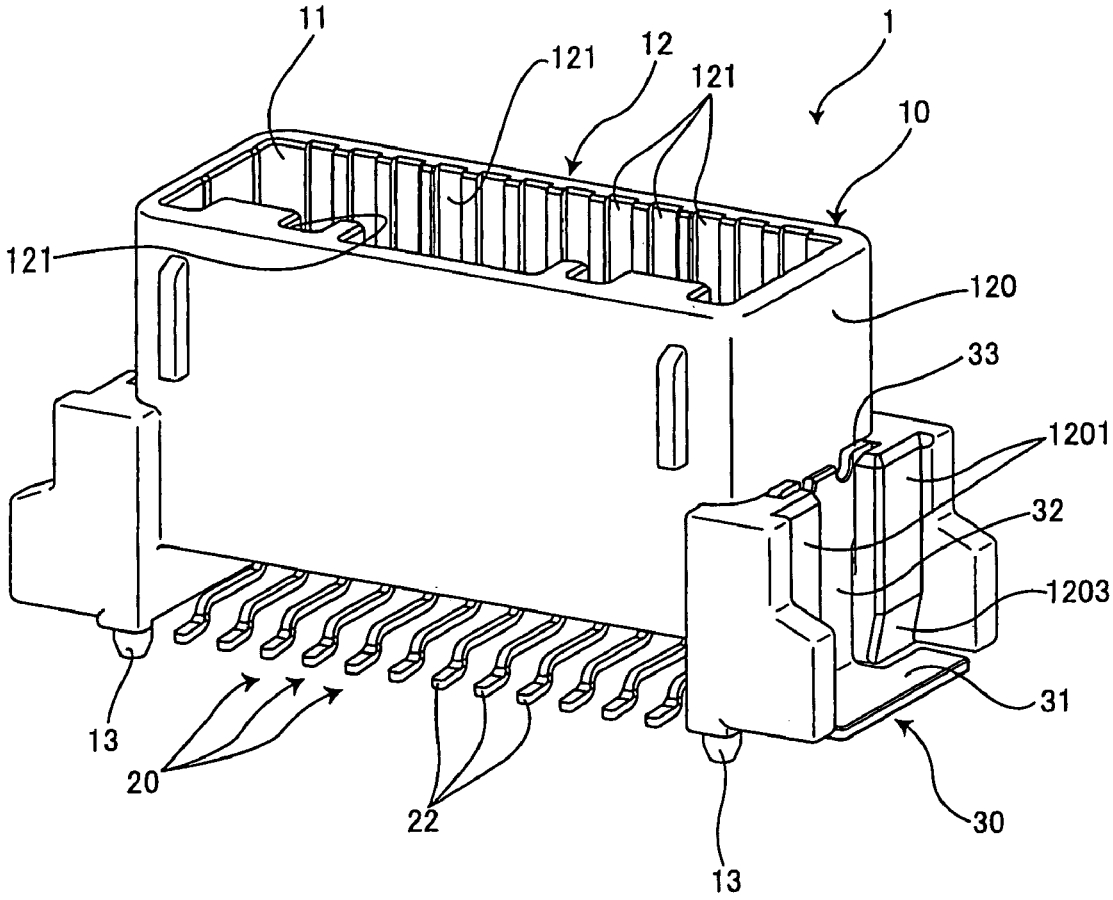
FIG. 1 is a perspective view of a connector according to a first embodiment of the invention.
Figure 2:
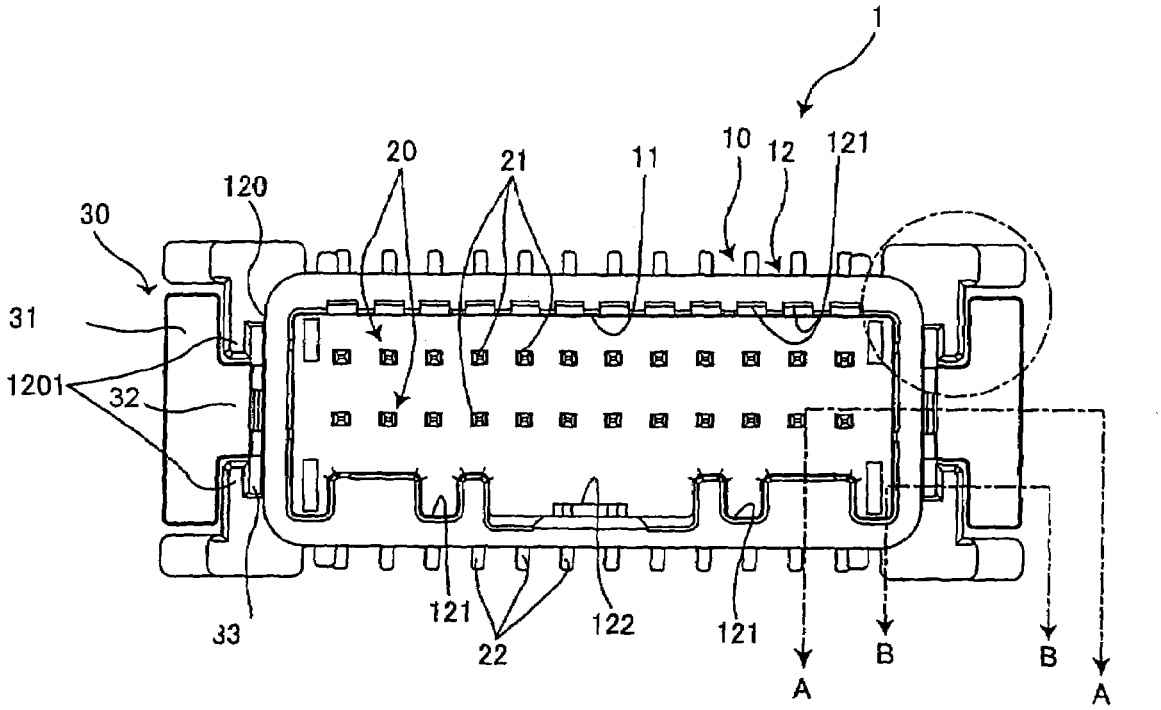
FIG. 2 is a top view of the connector shown in FIG. 1.
Figure 3:
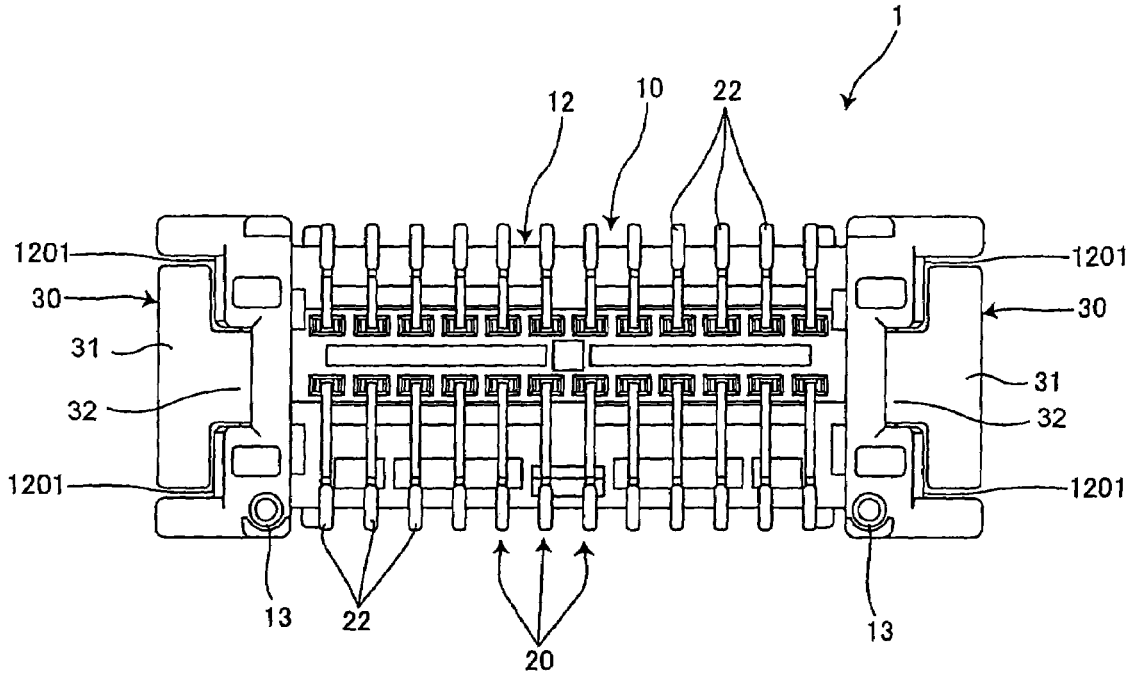
FIG. 3 is a bottom view of the connector shown in FIG. 1.
Figure 4:
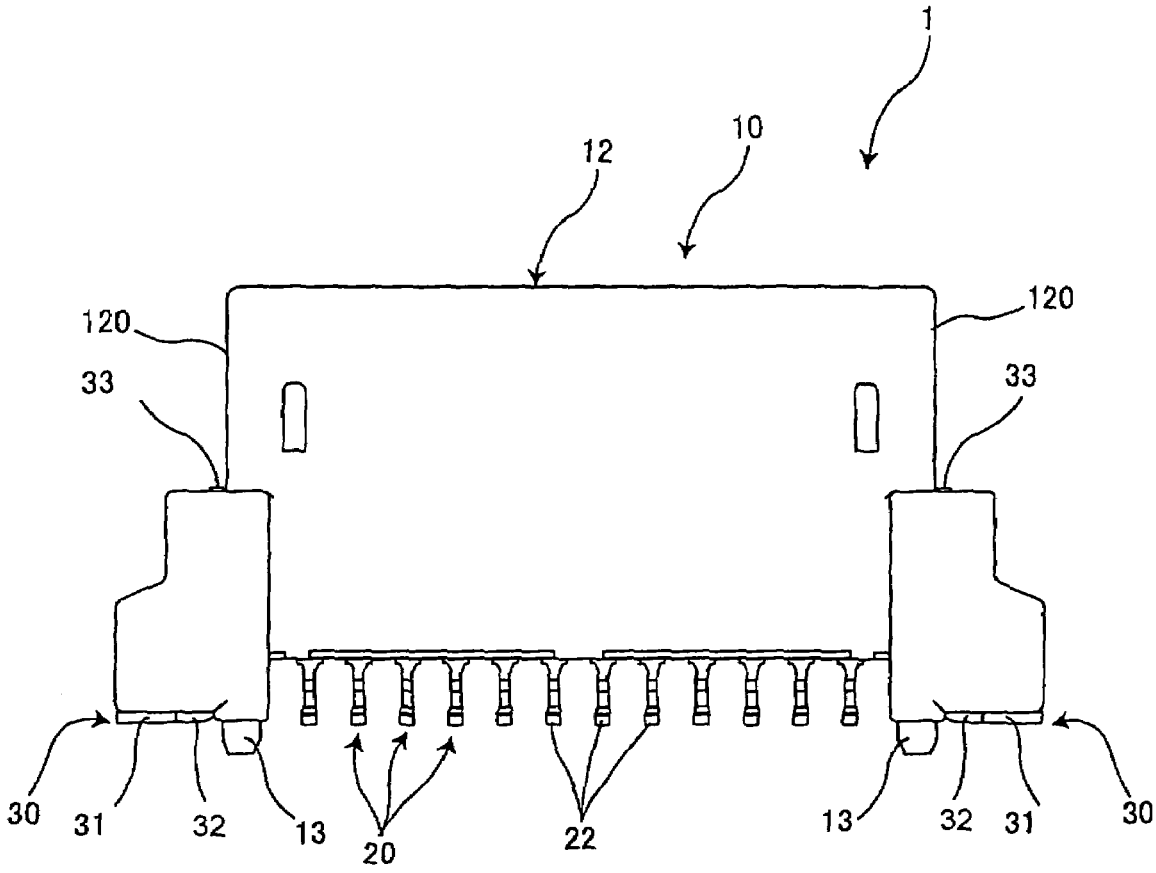
FIG. 4 is a plane view of the connector shown in FIG. 1.
Figure 5:
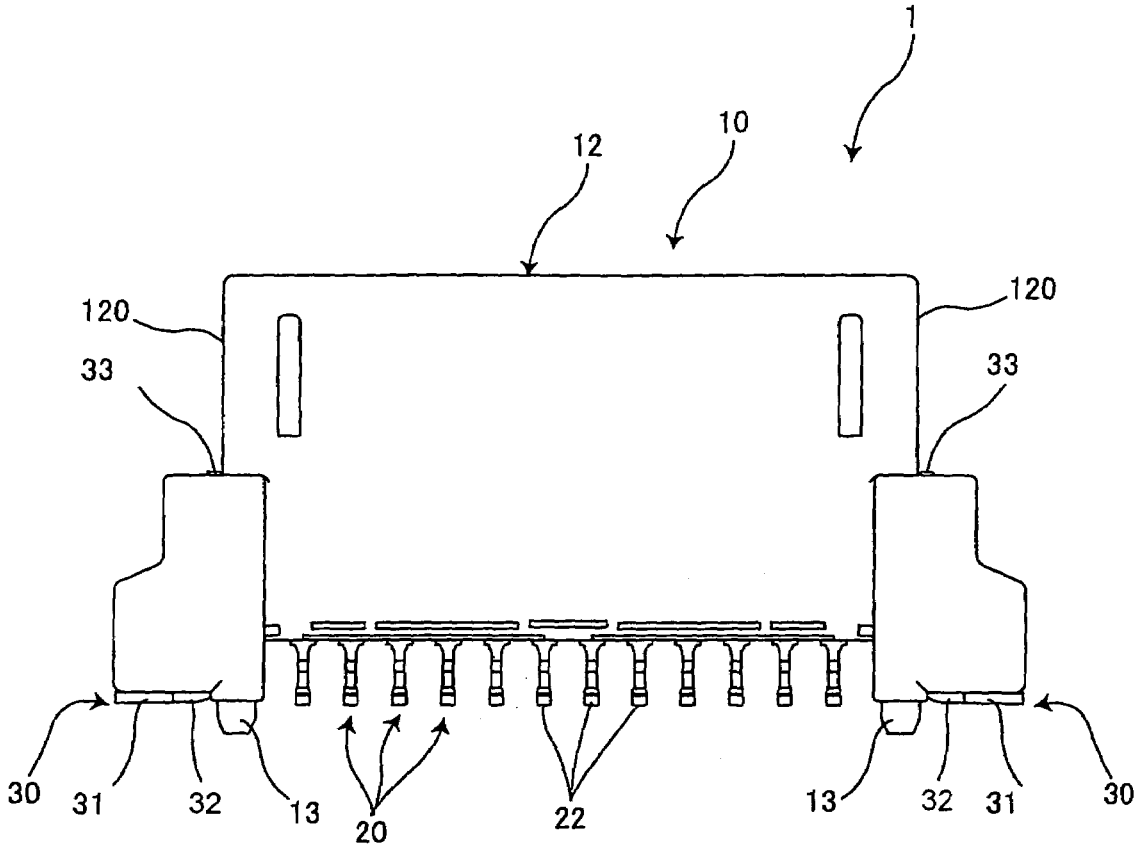
FIG. 5 is a bottom view of the connector shown in FIG. 1.
Figure 8:
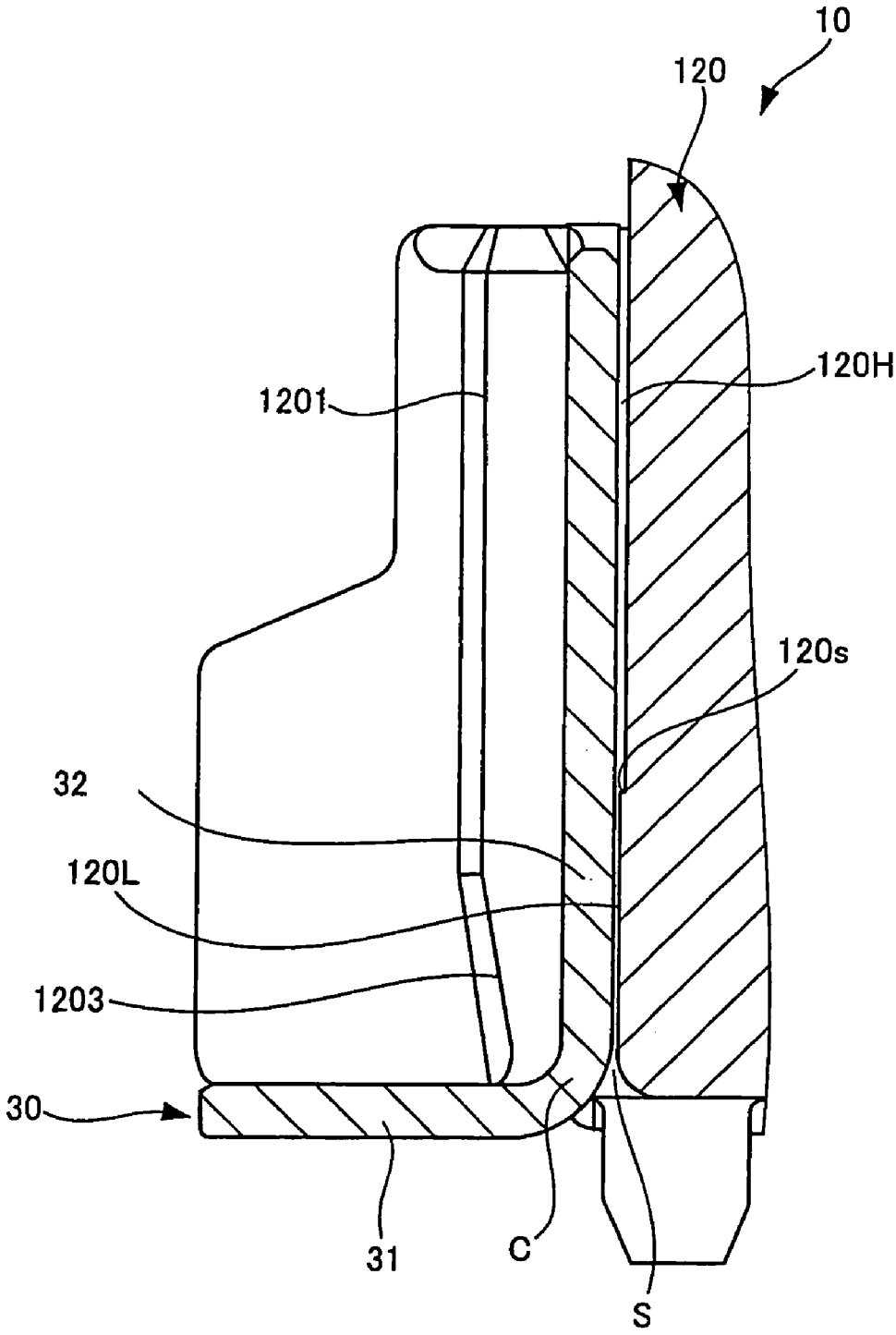
FIG. 8 is a sectional view taken along line A—A of FIG. 2.
Figure 9:
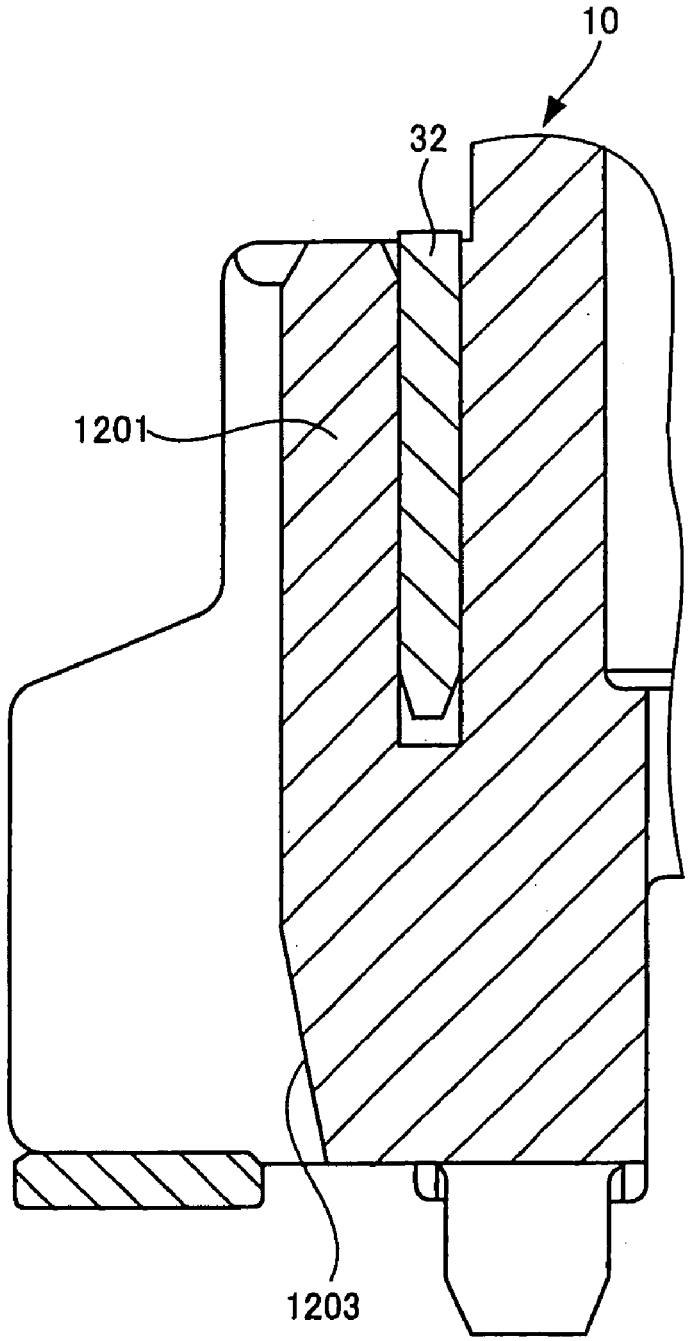
FIG. 9 is a sectional view taken along line B—B of FIG. 2.

FIG. 1 shows a connector 1 according to a first embodiment of the invention. The connector 1 shown in FIG. 1 is a SMT connector 1 that is mounted on a surface of a circuit board. As shown in FIG. 1, the connector 1 comprises a housing 10 with a circumferential wall 12 that defines a contact receiving opening 11. Bosses 13 extend from a bottom of the housing 10 and position the connector 1 relative to the circuit board. As shown in FIG. 2, a mating connector engagement member 122 and mating connector guide grooves 121 are formed on an inside surface of the circumferential wall 12. Sidewalls 120 of the housing are provided with steps 120*s*, as shown in FIG. 8.

As shown in FIG. 1, the contact receiving opening 11 is provided with a plurality of contacts 20. The contacts 20 are arranged, for example, in two rows. The contacts 20 are configured to stand upright in the housing 10, and the housing 10 is formed to enclose the upright portion of the contacts 20. As shown in FIG. 2, each of the contacts 20 has a mating section 21 for mating with a mating connector (now shown) and a lead section 22 for soldering to a pad on the surface of the circuit board.

Figure 6:
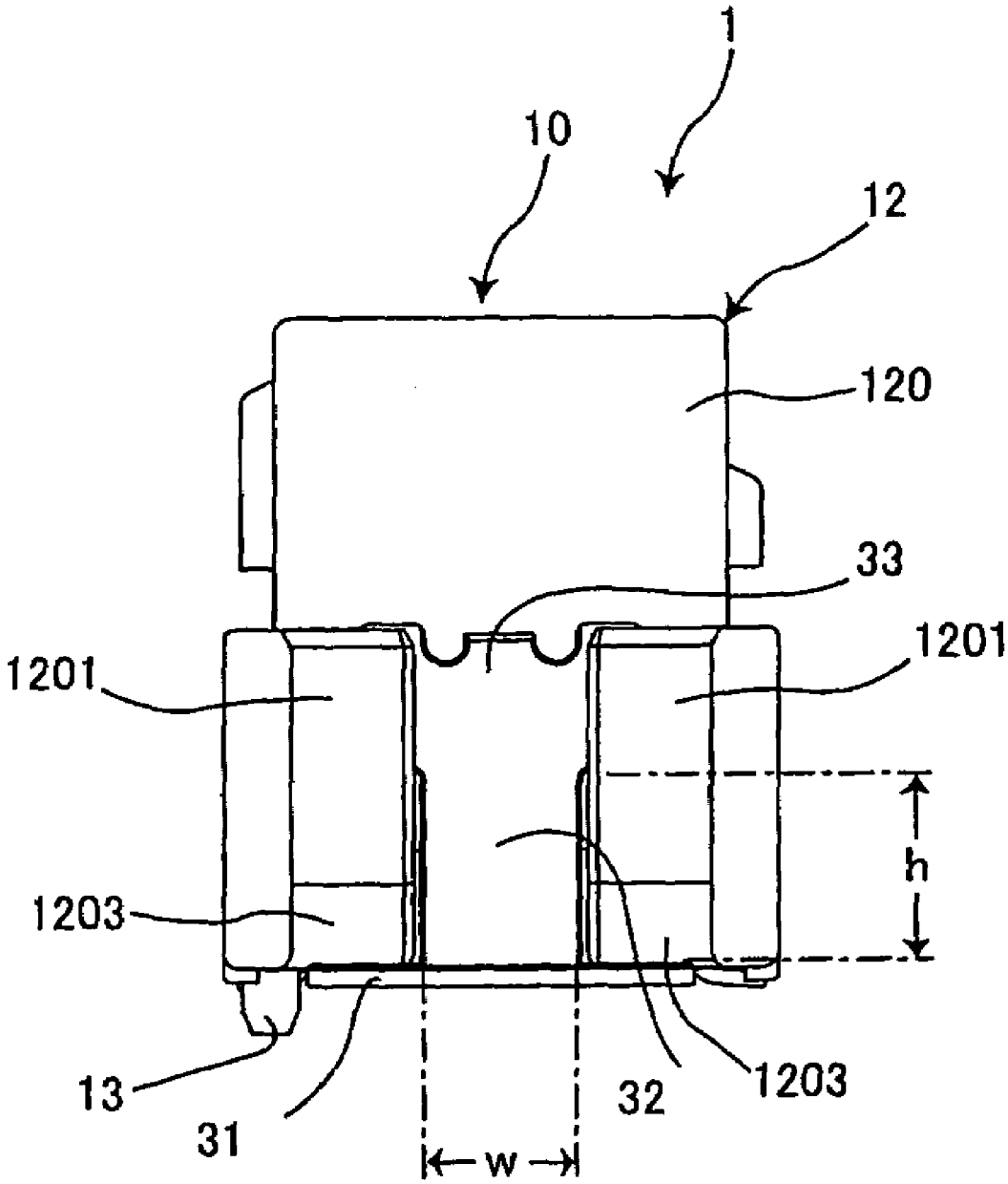
FIG. 6 is a side view of the connector shown in FIG. 1.

As shown in FIG. 1, metal fittings 30 are provided on the sidewalls 120 of the housing 10. The metal fitting 30 may be formed, for example, by stamping and forming a metal sheet. For example, the metal sheet may be stamped to form a pair of substantially T-shaped members having a soldering section 31, a fitting section 33, and a base 32. An approximate center of an edge of the soldering section 31 is attached to the base 32 and an approximate center of an edge of the fitting section 33 is attached to the base 32 such that the base 32 is positioned there between. The soldering section 31 faces the fitting section 33 in a direction of width, and the base 32 has a smaller width than the soldering section 31 and the fitting section 33. As shown in FIG. 6, the base 32 has a height h with respect to its longitudinal direction that is longer than its width w. The soldering section 31 and a portion of the base 32 are bent approximately perpendicular to the remainder of the base 32 and the housing 10 such that the portion extending from the housing 10 is substantially T-shaped. The remainder of the base 32 extends substantially parallel to the sidewall 120 of the housing 10. As shown in FIG. 8, the base 32 is substantially r-shaped about point C, which is linked to the soldering section 31.

The metal fittings 30 are fixed to the housing 10, for example, by press-fitting each end of the fitting section 33 in a direction of width in a press-fit section 1201 provided at ends of the housing 10 with respect to a longitudinal direction of the sidewall 120, as shown in FIG. 1. The metal fittings 30 are attached to the sidewalls 120 such that the base 32 is positioned along a bottom 120L of the sidewall 120, and the soldering section 31 protrudes outward from the bottom 120L of the sidewall 120, as shown in FIG. 8. A gap S is formed between the base 32 and the bottom 120L of the sidewall of the housing 10 at a position lower than the step 120*s*. The fitting section 33 is in contact with portion 120H at a depth (opposite to the reader) of a top of the sidewall 120 of the housing 10.

Figure 7:
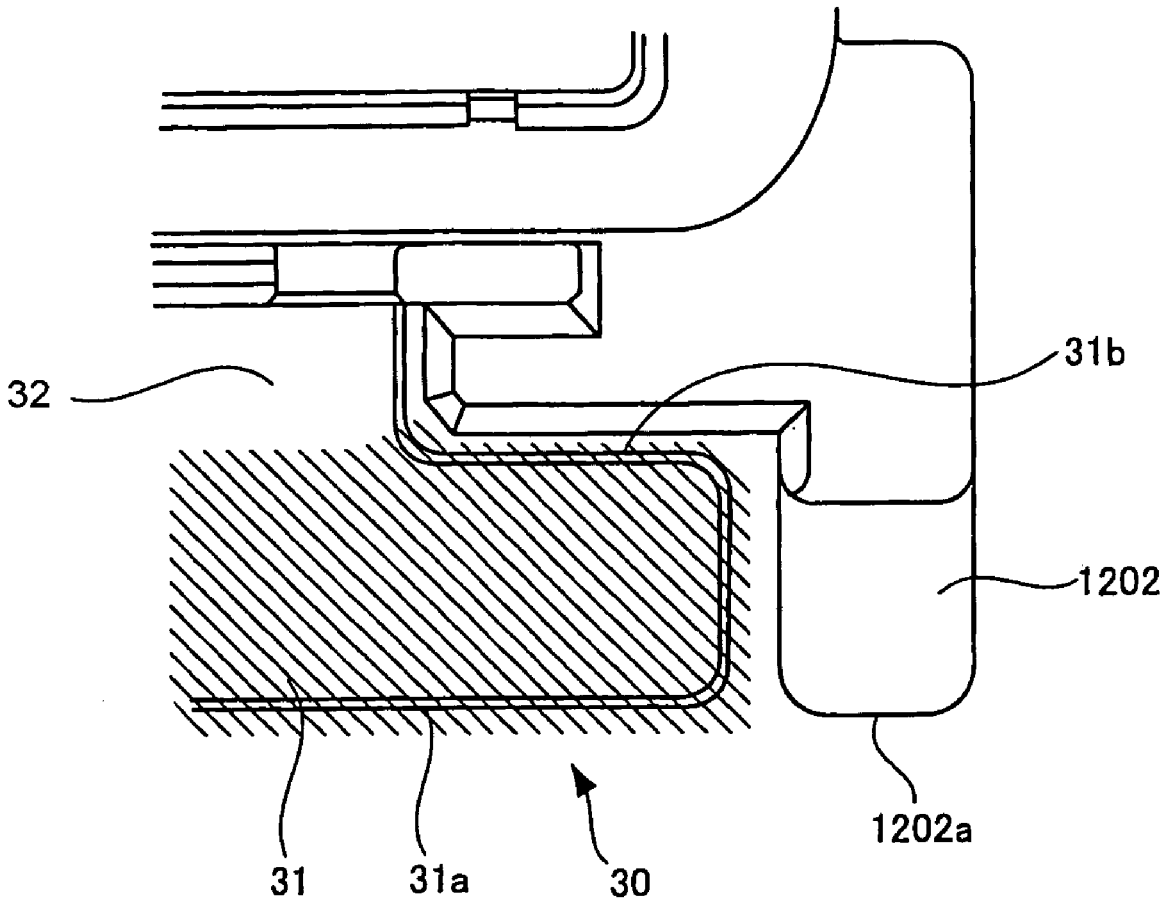
FIG. 7 is an enlarged view of the circled portion shown in FIG. 2.

The soldering section 31 is soldered to the surface of the circuit board, as shown in FIG. 7. Solder, which is illustrated by the hatched lines in FIG. 7, is applied to the soldering section 31 and an inner edge 31*b* of the soldering section 31 when it is soldered to the pad on the circuit board. Some of the solder may enter into the portion of the base 32, which extends away from the housing 10. The soldering section 31 may be, for example, soldered entirely around its perimeter and entirely across its surface.

As shown in FIG. 7, protection walls 1202 extend from the housing 10 in a direction of width of the soldering section 31. As shown in FIG. 7, an end 1202*a* of the protection wall 1202 extends slightly beyond an outer edge 31*a* of the soldering section 31. The protection wall 1202 is provided to protect the soldering section 31 of the connector 1 from impacts.

As shown in FIGS. 1 and 6, below the press-fit sections 1201, are solder viewing sections 1203. The solder viewing sections 1203 are connected to the press-fit sections 1201 of the housing 10 and are positioned adjacent to the base 32. The solder viewing sections 1203 retract inward toward the bottom 120L of the housing 10 as the solder viewing sections 1203 approach the soldering section 31 of the housing 10. Although the solder viewing sections 1203 are show as being tapered in the illustrated embodiment, the solder viewing sections 1203 may alternatively have a recess, for example, an upturned L-shaped recess indented from the press-fit section 1201.

In the connector 1 according to the invention, the solder viewing sections 1203, which are positioned at each side of the base 32, retract inward and thereby enable the solder to easily enter across the perimeter of the soldering section 31 including the inner edge 31*b* of the soldering section 31. As a result, the metal fitting 30 is securely soldered to the circuit board and visual inspection of the solder from above is possible, even if the inner edge 31*b* of the soldering section 31 is near the bottom 120L of the sidewall 120. Thus, the connector 1 is configured such that the metal fitting 30 can be securely soldered to the circuit board and visual inspection of the solder is capable of being performed while minimizing the mounting area of the connector 1. In addition, the mounting area of the connector 1 can be minimized because the inner edge 31*b* of the soldering section 31 is close to the bottom 120L of the sidewall 120 of the housing 10.

The housing 10 of the connector 1 of the present invention may be formed, for example, from a heat-resistant engineering plastic such as polyphenylene sulfide (PPS). The circuit board may be made, for example, from glass epoxy resin-system materials. Accordingly, there is a difference in the amount of thermal expansion and contraction between the housing 10 and the circuit board. When the thermal expansion of the housing 10 is larger than that of the circuit board, the gap S in FIG. 8 tolerates the expanded housing 10. In addition, when the thermal contraction of the circuit board is larger than that of the housing 10, the gap S in FIG. 8 tolerates change in the position of the base 32 relative to the sidewall 120 of the housing 10. Consequently, the metal fitting 30, whose soldering section 31 is soldered to the circuit board, can avoid pressure from the sidewall 120 of the housing 10, which alleviates stress applied to the soldering section 31.

Because the height h of the base 32 is slightly longer than the width w of the base 32, the base 32 has some flexibility. Therefore, tension applied to the metal fitting 30 is absorbed by the flexibility of the base 32 even if thermal expansion of the circuit board is larger than that of the housing 10 and the expanded circuit board tries to pull the metal fitting 30. In addition, if the thermal contraction of the housing 10 is larger than that of the circuit board, and the contracted housing 10 tries to pull the metal fitting 30, tension applied to the metal fitting 30 is absorbed by the flexibility of the base 32. In both cases, stress applied to the soldering section 31 of the metal fitting 30 is alleviated, which can prevent removal of the metal fitting 30 from the circuit board, even if the housing 10 or the circuit board contracts after it has expanded. Consequently, the connector 1 can be securely mounted, for example, on a circuit board in an automobile where it is subjected to sudden changes in ambient temperature or, for example, on a circuit board loaded with a heat-producing component.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A surface mount technology connector, comprising:

a housing provided with plurality of contacts;

at least one metal fitting fixed to a sidewall of the housing, the metal fitting having a base and a soldering section for soldering to a circuit board, the base having a smaller width than the soldering section, the soldering section extending from a substantial center of the base with respect to the width thereof, the soldering section and a portion of the base extending approximately perpendicular to and away from the sidewall of the housing; and the sidewall of the housing having a solder viewing section at each side of the base, the solder viewing section retracting inward as the solder viewing section approaches the soldering section to expose the soldering section at the bottom of the sidewall of the housing.

2. The surface mount technology connector of claim 1, wherein the soldering section and the portion of the base extending approximately perpendicular to and away from a bottom of the sidewall of the housing have a substantially T-shape.

3. The surface mount technology connector of claim 1, wherein the metal fitting includes a fitting section that is fixed in a press-fit section provided on the housing.

4. The surface mount technology connector of claim 1, wherein a remainder of the base extends substantially parallel to the sidewall.

5. The surface mount technology connector of claim 4, wherein the sidewall includes a step and the remainder of the base is positioned adjacent thereto so that the remainder of the base is capable of flexing.

6. The surface mount technology connector of claim 1, further comprising protection walls extending from the housing further than the soldering section, one of the protection walls positioned on each side of the soldering section.

7. The surface mount technology connector of claim 1, wherein a gap exists between the base and the bottom of the sidewall of the housing.

8. The surface mount technology connector of claim 1, wherein the contacts are configured to stand upright in the housing.

9. The surface mount technology connector of claim 1, wherein the base has a height greater than the width of the base.

10. A surface mount technology connector, comprising:

a housing provided with a plurality of contacts; and at least one metal fitting fixed to a sidewall of the housing, the metal fitting having a base and a soldering section for soldering to a circuit board, the base having a portion extending substantially parallel to the sidewall that is spaced from the sidewall such that a gap is formed there between, the soldering section extending from a substantial center of the base with respect to a width thereof approximately perpendicular to and away from a bottom of the sidewall of the housing.

11. The surface mount technology connector of claim 10, wherein the base has a height greater than the width of the base.

12. The surface mount technology connector of claim 10, wherein the sidewall of the housing has a solder viewing section at each side of the base that exposes the soldering section at the bottom of the sidewall of the housing.

13. The surface mount technology connector of claim 10, wherein the metal fitting has a substantially T-shape.

14. The surface mount technology connector of claim 10, wherein the metal fitting includes a fitting section that is fixed in a press-fit section provided on the housing.

15. The surface mount technology connector of claim 10, wherein the sidewall includes a step and the base is positioned adjacent thereto so that the base is capable of flexing.

16. The surface mount technology connector of claim 10, further comprising protection walls extending from the housing further than the soldering section, one of the protection walls positioned on each side of the soldering section.

17. The surface mount technology connector of claim 10, wherein the contacts are configured to stand upright in the housing.

18. The surface mount technology connector of claim 10, wherein a portion of the base extends approximately perpendicular to and away from a bottom of the sidewall of the housing.

19. The surface mount technology connector of claim 18, wherein the soldering section and the portion of the base extending approximately perpendicular to and away from a bottom of the sidewall of the housing have a substantially T-shape.

20. The surface mount technology connector of claim 14, wherein the base has a smaller width than the soldering section and the fitting section.

* * * * *

UNITED STATES PATENT AND TRADEMARK OFFICE

CERTIFICATE OF CORRECTION

PATENT NO. : 7,179,094 B2
APPLICATION NO. : 11/261381
DATED : February 20, 2007
INVENTOR(S) : Kawahara et al.

It is certified that error appears in the above-identified patent and that said Letters Patent is hereby corrected as shown below:

On the Title page under U.S. Patent Documents item 56, insert -- 6,464,515 * 10/2002 Wu 439/108 --.

Col. 4, Line 58
In claim 1, line 2, "a housing provided with plurality of contacts" should read -- a housing provided with a plurality of contacts --.

Col. 4, Line 66
In claim 1, line 10, "to and away from the sidewall" should read -- to and away from a bottom of the sidewall --.

Col. 5, Line 8-9
In claim 2, lines 3-4, "a bottom" should read -- the bottom --.

Col. 6, Line 30
In claim 18, line 3, "a bottom" should read -- the bottom --.

Col. 6, Line 34-35
In claim 19, lines 3-4, "a bottom" should read -- the bottom --.

Signed and Sealed this

Tenth Day of July, 2007

JON W. DUDAS
*Director of the United States Patent and Trademark Office*